United States Patent [19]

Ruhl

[11] Patent Number: 4,616,763

[45] Date of Patent: Oct. 14, 1986

[54] TAMPER-EVIDENT DISPOSABLE CAP FOR CONTAINER VALVE PLUG

[75] Inventor: Gerald F. Ruhl, Greenville, Ohio

[73] Assignee: Replicap Products, Inc., Greenville, Ohio

[21] Appl. No.: 804,684

[22] Filed: Dec. 3, 1985

[51] Int. Cl.[4] ..... B65D 41/32

[52] U.S. Cl. ..... 220/270; 220/85 P; 222/182; 137/377; 137/382

[58] Field of Search ..... 220/85 P, 270, 257, 220/266, 268; 215/251; 222/182, 153, 541; 137/377, 381, 382, 384, 797

[56] References Cited

U.S. PATENT DOCUMENTS 4,095,713 6/1978 Norton ..... 220/270

4,318,495 3/1982 Wood ..... 220/85 P

*Primary Examiner*—George T. Hall

*Attorney, Agent, or Firm*—Jacox & Meckstroth

[57] ABSTRACT

Two valve plugs project upwardly from a liquid containing tank and are each covered by a one-piece cap of molded plastics material. Each cap includes an inverted cup-shaped cylindrical portion completely enclosing the upper portion of the plug and integrally connected to a larger depending annular skirt portion by peripherally spaced frangible ties. Peripherally spaced spring finger elements are integrally molded with the skirt portion for positively engaging the valve plug to lock the cap to the valve plug. The skirt portion has at least one vertical slot and a tab which is pulled to tear the frangible ties and separate the skirt portion and the finger elements from the cover portion when access to the valve plug is desired. In one embodiment, the spring finger elements hook onto a frusto-conical portion of the valve plug, and in another embodiment, the finger elements engage radially projecting coupling pins on a valve plug.

16 Claims, 7 Drawing Figures

TAMPER-EVIDENT DISPOSABLE CAP FOR CONTAINER VALVE PLUG

BACKGROUND OF THE INVENTION

In the distribution of liquid beverages, it is common to use generally cylindrical metal tanks each having an upper end wall with a removable closure and two upwardly projecting valve plugs. The valve plugs form parts of quick-connect couplings which releasably connect corresponding flexible hoses to the plugs for pressurizing the tank and for supplying the liquid in the tank to a liquid dispenser. Sometimes the valve plugs are protected by sanitary dust caps, for example, as disclosed in U.S. Pat. No. 4,318,495 which issued to the assignee of the present invention. In addition to the sanitary dust caps, it is sometimes desirable to provide the cap with tamper-evident means which provide an indication if the cap has been removed, for example, as disclosed in U.S. Pat. No. 4,095,713. However, the tamper-evident cap disclosed in the latter patent has several openings in the upper portion of the cap, and the openings prevent the cap from forming a sanitary cover for the valve plug.

SUMMARY OF THE INVENTION

The present invention is directed to an improved protective tamper-evident disposable cap for a valve plug used on a liquid container and which not only provides for an indicator if the cap has been removed but also provides for completely covering and enclosing the upper end portion of the valve plug which receives the female portion of the quick-connect coupling. The improved cap of the invention is also adapted to be economically molded in one piece of a plastics material and may be easily and quickly installed on a valve plug simply by pressing the cap axially onto the plug.

The above advantages and features are provided by one embodiment of the invention wherein an inverted cup-shaped cylindrical portion is integrally connected to a larger depending skirt portion by peripherally spaced frangible ties, and peripherally spaced spring fingers project downwardly from the upper end of the skirt portion outboard of the frangible ties. The spring fingers have lower end hook portions which are located to engage an annular shoulder on the valve plug. A tab projects horizontally from the top of the skirt portion and provides for tearing the frangible ties to separate the skirt portion and the spring fingers from the upper cup portion when it is desired to access the valve plug. In another embodiment, the skirt portion has peripherally spaced ribs defining internal vertical grooves, and spring fingers project upwardly within the grooves from the bottom of the ribs for engaging outwardly projecting locking pins on the valve plug.

Other features and advantages of the invention will be apparent from the following description, the accompanying drawing and the appended claims.

DESCRIPTION OF THE PREFERRED EMBODIMENTS

Figure 1:
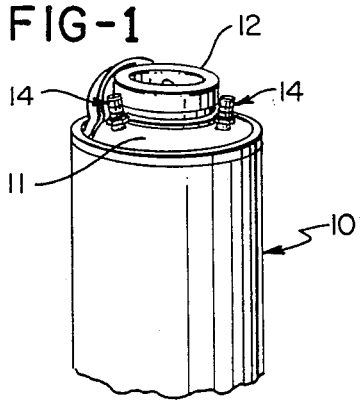
FIG. 1 is a fragmentary perspective view of a beverage tank having upwardly projecting valve plugs for receiving disposable caps constructed in accordance with the invention.

FIG. 1 illustrates a portable metal tank or container 10 which is commonly used for transporting a liquid beverage. The container 10 has a top end wall 11 with an opening which receives a closure 12 adapted to be removed for filling the container. A set of valve plugs 14 project upwardly from the top end wall 11 of the container and are adapted to receive quick-connect couplings (not shown) on the ends of corresponding flexible hoses. Each of the valve plugs 14 includes an upper cylindrical portion 16 having a circumferential groove which receives an O-ring seal 17. A reduced neck portion 19 connects the cylindrical portion 16 to a frusto-conical portion 22 which cooperates with a reduced cylindrical portion 23 to define an annular shoulder 26. The cylindrical portion 23 connects with a hexagonal base portion 27 which is adapted to receive a wrench for threading the valve plug 14 into a threaded hole within the top wall 11 of the container 10.

In accordance with the present invention, a protective tamper-evident disposable cap 30 is molded of a plastics material as a single piece and includes an upper generally cylindrical and inverted cup-shaped cover portion 32 and a somewhat larger lower cylindrical skirt portion 34. A plurality of peripherally spaced frangible ties 36 integrally connect the lower edge of the cover portion 32 to an annular or radial wall 38 forming the upper end of the skirt portion 34. The annular or radial wall 38 projects outwardly from one side of the skirt portion 34 to form a gripping tab 42, and the cylindrical skirt portion 34 is interrupted by two diametrically opposed vertical slots 44 which also interrupt the annular wall 38.

Figure 3:
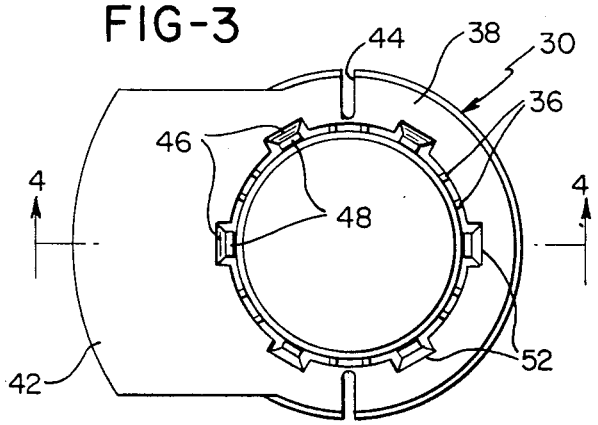
FIG. 3 is an enlarged top view of the disposable cap shown in FIG. 2.
Figure 4:
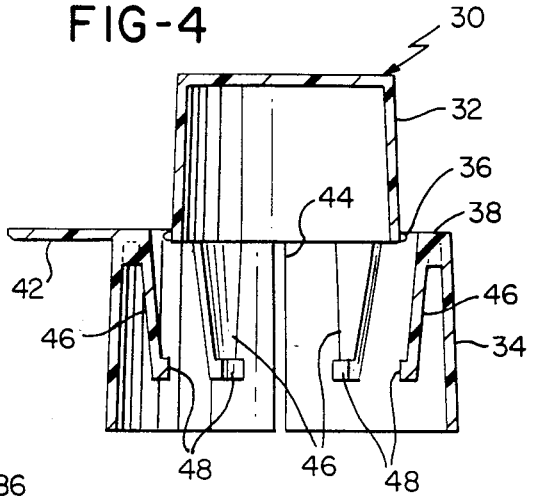
FIG. 4 is an axial section of the cap taken generally along the line 4—4 of FIG. 3.

Referring to FIG. 4, a plurality of six circumferentially spaced spring elements or fingers 46 project downwardly from the annular wall 38 within the skirt portion 34, and each spring finger 46 has a lower hook portion 48 having a square cross-sectional configuration. A rectangular opening 52 (FIG. 3) is formed within the annular wall 38 directly above each of the fingers 46 and provides for simplified molding of the fingers 46 as integral part of the cap 30 without having any slides in the mold.

Figure 2:
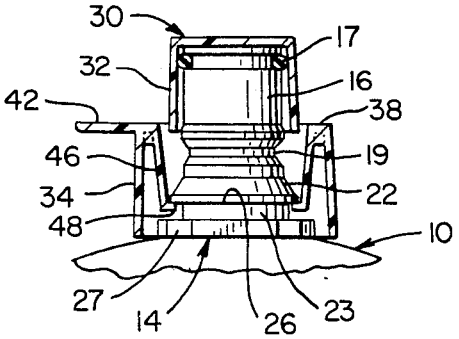
FIG. 2 is an elevational view of a valve plug shown in FIG. 1 and illustrating its protection by a disposable cap constructed in accordance with the invention and shown in axial cross-section.

As apparent from FIG. 2, when a cap 30 is pressed onto a valve plug 14, the lower end portions 48 of the spring fingers 46 are forced outwardly by the tapered surface 22 on the valve plug 14. Before the lower edge of the skirt portion 34 contacts the tank or container 10, the hook portions 48 snap inwardly under the radial surface or shoulder 26 and thereby secure or lock the cap 30 to the valve plug 14. In this position of the cap 30, the entire valve plug 14 is covered, and the upper portion of the valve plug is completely enclosed by the upper cover portion 32 of the cap 30.

When it is desired to remove the cap 30 from the valve plug 14, the tab 42 is gripped and pulled upwardly and outwardly to break the frangible ties 36 on one half section of the skirt portion 34. The opposite half section of the skirt portion 34 is then pulled upwardly and outwardly to tear its connecting ties 36, after which the cover portion 32 of the cap 30 may be removed or lifted from the upper portion of the valve plug 14.

Figure 6:
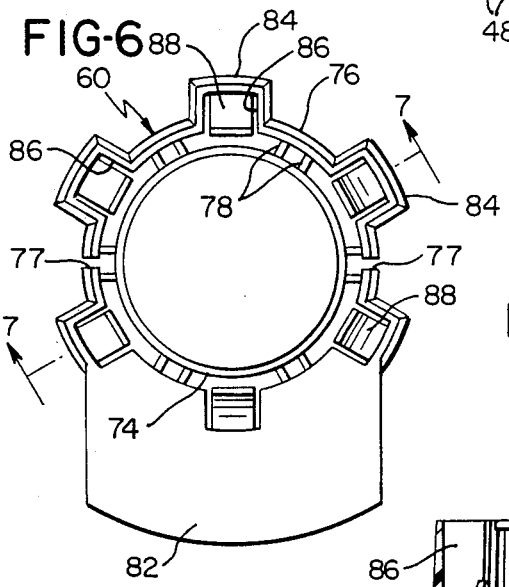
FIG. 6 is an enlarged top view of the protective cap shown in FIG. 5.
Figure 5:
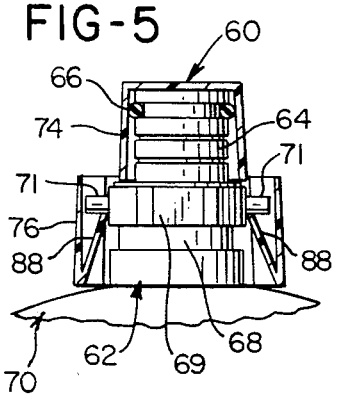
FIG. 5 is an elevational view of another type of valve plug covered by a protective cap constructed in accordance with another embodiment of the invention.
Figure 7:
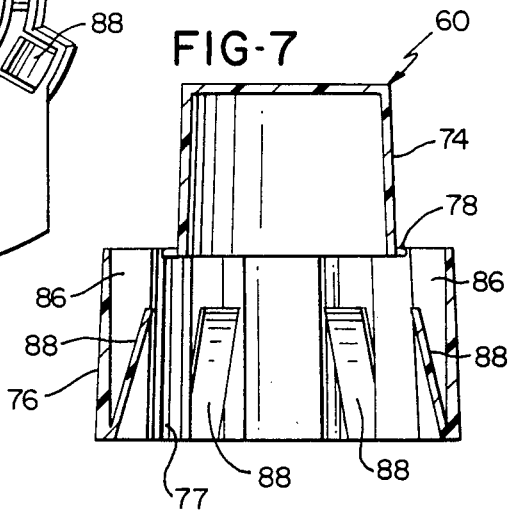
FIG. 7 is an axial section taken generally on the line 7—7 of FIG. 6.

Referring to FIGS. 5–7, a protective cap 60 is constructed in accordance with a modification of the invention for covering and protecting another form of valve plug 62 which has an upper cylindrical portion 64 with a groove retaining an O-ring seal 66. The lower portion 68 of the valve plug 62 has a hexagonal base 69 for receiving a wrench to thread the valve plug 62 into a threaded hole within a container 70 and for tightening the valve plug in the same manner as the valve plug 14 described above is attached. A plurality of two or three locking pins 71 project radially outwardly from the lower portion 68 of the valve plug 62 and are used for securing or locking the quick-connect hose coupling (not shown) to the valve plug 62 with a bayonet-type coupling action.

The protective cap 60 is also molded from a plastics material in one piece and includes an inverted cup-shaped cylindrical cover portion 74 and a lower skirt portion 76. The skirt portion 76 is interrupted by diametrically opposed slots 77 and is integrally connected to the cover portion 74 by peripherally spaced pairs of frangible ties 78. A flange or tab 82 projects outwardly from the upper edge of the skirt portion 76 in a radial plane in the same manner as the tab 42 described above.

The skirt portion 76 includes a plurality of six peripherally spaced channel sections 84 which define corresponding vertical grooves or slots 86 orientated to receive the pins 71 on the valve plug 62. A flat spring finger 88 projects upwardly on an incline within each of the slots 86 and has its lower end portion integrally connected to the bottom of the skirt portion 76 forming the outer wall of the corresponding channel section 84.

The protective cap 60 is pressed onto a valve plug 62 after the channel sections 84 on the cap are aligned with the corresponding pins 71 on the valve plug 62. The valve plug 62 usually has either two diametrically opposed pins 71 or three pins 71 spaced uniformally at angles of 120 degrees. The cap 60 accommodates either valve plug. As the cap 60 is pressed onto the valve plug 62, the pins 71 force the spring fingers 88 outwardly. When the lower edge of the skirt portion 76 approaches contact with the upper wall of the container 70 so that the valve plug 62 is completely enclosed, the spring fingers 88 clear the pins 71 and snap inwardly to their normal positions under the pins 71, as shown in FIG. 5. Thus the fingers 88 cooperate with the pins 71 to lock the cap 60 to the valve plug 62.

When it is desired to remove the cap 60 from the corresponding valve plug 62 which it covers and protects, the tab 82 is gripped and pulled upwardly and outwardly which tears the frangible ties 78 and separates one half section of the skirt portion 76 from the cover portion 74. The other half section of the skirt portion 76 is then pulled to tear its connecting ties 78 and to separate this section from the cover portions 74. If desired, a flexible link may integrally connect the half sections of the skirt portion 76 across one of the slots 77 so that pulling on the tab 82 is effective to remove both half sections of the skirt portion 76 in succession from the cover portion 74. This same feature may also be incorporated in the protective cap 30 described above so that both half sections of the skirt portion 34 are removed in succession when the tab 42 is pulled outwardly to tear progressively the frangible ties 36.

From the drawing in the above description, it is apparent that a protective cap constructed in accordance with the present invention, provides desirable features and advantages. For example, the caps 30 and 60 each provide an upper fluid-tight inverted cup portion which completely encloses the upper end portion of the corresponding valve plug to avoid dust and other contaminates from contacting the upper portion of the valve plug. Each of the caps 30 and 60 may also be quickly installed on a valve plug simply by pressing the cap downwardly onto the plug. In each cap, the internal spring fingers 46 or 88 positively lock the cap to the valve plug and are located within the skirt portion so that they are not accessible to someone who would like to remove the cap without rupturing or tearing the frangible ties. As another feature, the frangible ties provide for quickly removing the skirt portion of the protective cap and separating the skirt portion and the internal locking fingers from the upper cover portion when it is desired to remove the cap from the valve plug.

While the forms of caps herein described constitute preferred embodiments of the invention, it is to be understood that the invention is not limited to these precise forms of caps, and that changes may be made therein without departing from the scope and spirit of the invention as defined in the appended claims.

The invention having thus been described, the following is claimed:

1. A protective one-piece tamper-evident cap for mouting on a valve plug projecting from a fluid container, said cap being molded of a plastics material and comprising an inverted cup-shaped upper cover portion having an annular wall completely surrounding the plug and being closed by a top wall, said cap further including an annular lower skirt portion projecting downwardly from said upper cover portion and being larger in cross-section than said cover portion, a plurality of peripherally spaced frangible ties integrally connecting said upper cover portion to said lower skirt portion, a plurality of peripherally spaced spring fingers integrally connected to said lower skirt portion outwardly of said frangible ties and positioned to engage the valve plug, and means for separating said lower skirt portion and said fingers from said upper cover portion by breaking said frangible ties in response to a force manually applied to one of said portions of said cap to provide access to the valve plug.

2. A disposable cap as defined in claim 1 wherein said spring fingers extend downwardly within said skirt portion from the upper edge of said skirt portion, and said fingers each have a hook-shaped free lower end portion for engaging an annular shoulder on the valve plug.

3. A disposable cap as defined in claim 1 wherein said spring fingers extend upwardly and inwardly within said skirt portion from the bottom edge of said skirt portion, and said fingers have upper end portions adapted to snap inwardly under outwardly projecting locking pins on the valve plug.

4. A disposable cap as defined in claim 3 wherein said skirt portion of said cap includes peripherally spaced channel sections each defining an internal slot for receiving a locking pin on the valve plug, and each of said spring fingers is disposed within one of said channel sections.

5. A disposable cap as defined in claim 1 wherein said cup-shaped upper cover portion of said cap is free of any openings to provide a sanitary cover for the valve plug.

6. A disposable cap as defined in claim 1 wherein said frangible ties extend generally within a radial plane perpendicular to the center axis of said cap.

7. A disposable cap as defined in claim 1 and including a gripping tab portion projecting outwardly from said skirt portion.

8. A disposable cap as defined in claim 1 and including an annular wall portion connecting said frangible ties to said skirt portion, and means defining peripherally spaced openings within said annular wall portion directly above said spring fingers.

9. A disposable cap as defined in claim 1 wherein said skirt portion has at least one axially extending slot to facilitate separating said skirt portion from said cover portion.

10. A protective one-piece tamper-evident cap for mounting on a valve plug projecting from a fluid container, said cap being molded of a plastics material and comprising an inverted cup-shaped upper cover portion having an annular wall completely surrounding the plug and being closed by a top wall, said cap further including an annular lower skirt portion projecting downwardly from said upper cover portion and being larger in cross-section than said cover portion, a plurality of peripherally spaced and radially extending frangible ties integrally connecting said upper cover portion to said lower skirt portion, a plurality of peripherally spaced spring fingers integrally connected to the upper part of said lower skirt portion outwardly of said frangible ties and projecting downwardly within said skirt portion for engaging the valve plug, and means for separating said lower skirt portion and said spring fingers from said upper cover portion by breaking said frangible ties in response to a force manually applied to one of said portions of said cap to provide access to the valve plug.

11. A disposable cap as defined in claim 10 wherein said spring fingers each have a lower hook-shaped free end portion for engaging an annular shoulder on the valve plug.

12. A disposable cap as defined in claim 10 wherein said cup-shaped upper cover portion of said cap is free of any openings to provide a sanitary cover for the valve plug.

13. A protective one-piece tamper-evident cap for mounting on a valve plug projecting from a fluid container, said cap being molded of a plastics material and comprising an inverted cup-shaped upper cover portion having an annular wall completely surrounding the plug and being closed by a top wall, said cap further including an annular lower skirt portion projecting downwardly from said upper cover portion and being larger in cross-section than said cover portion, a plurality of peripherally spaced and radially extending frangible ties integrally connecting said upper cover portion to said lower skirt portion, a plurality of peripherally spaced spring fingers integrally connected to the lower part of said lower skirt portion outwardly of said frangible ties and projecting upwardly within said skirt portion, said fingers having upper end portions adapted to snap under outwardly projecting locking pins on the valve plug, and means for separating said lower skirt portion and said spring fingers from said upper cover portion by breaking said frangible ties in response to a force manually applied to one of said portions of said cap to provide access to the valve plug.

14. A disposable cap as defined in claim 13 wherein said skirt portion of said cap includes peripherally spaced channel sections each defining an internal slot for receiving a locking pin on the valve plug, and each of said spring fingers is disposed within one of said channel sections.

15. A disposable cap as defined in claim 14 wherein each of said channel sections has an open top end and an open bottom end.

16. A disposable cap as defined in claim 13 wherein said cup-shaped upper cover portion of said cap is free of any openings to provide a sanitary cover for the valve plug.

* * * * *